US005445838A

United States Patent [19]

Lipinski et al.

[11] Patent Number: 5,445,838

[45] Date of Patent: * Aug. 29, 1995

[54] PEELABLE AND RESEALABLE PACKAGE FOR THINLY SLICED MEATS AND THE LIKE

[75] Inventors: Jeffrey M. Lipinski, Waunakee; Brian P. Lawless, Madison, both of Wis.

[73] Assignee: Oscar Mayer Foods Corporation, Madison, Wis.

[ * ] Notice: The portion of the term of this patent subsequent to Mar. 7, 2012 has been disclaimed.

[21] Appl. No.: 95,806

[22] Filed: Jul. 21, 1993

Related U.S. Application Data

[63] Continuation of Ser. No. 876,594, Apr. 30, 1992, abandoned, which is a continuation-in-part of Ser. No. 696,327, Apr. 30, 1991, Pat. No. 5,395,632, which is a continuation of Ser. No. 505,329, Apr. 5, 1990, abandoned.

[51] Int. Cl.[6] ..... B65D 85/00

[52] U.S. Cl. ..... 426/129; 426/397; 426/410

[58] Field of Search ..... 426/129, 130, 128, 127, 426/106; 206/484; 53/116, 247, 243, 447, 448, 540, 531, 532

[56] References Cited

U.S. PATENT DOCUMENTS

| | | | |
|---|---|---|---|
| D. 299,085 | 12/1988 | Martinez | D3/34 |
| 2,596,514 | 5/1952 | Uehlein | 99/174 |
| 2,793,745 | 5/1957 | Cox, Jr. | 206/56 |
| 3,191,849 | 6/1965 | Gutowski et al. | 229/55 |
| 3,257,228 | 6/1966 | Reed | 117/76 |
| 3,329,331 | 7/1967 | Morgan | 229/51 |
| 3,338,723 | 8/1967 | Lundquist | 99/174 |
| 3,371,848 | 3/1968 | Ward et al. | 229/45 |
| 3,395,788 | 8/1968 | Gill | 206/45.34 |
| 3,428,171 | 2/1969 | Blish | 206/78 |
| 3,502,486 | 3/1970 | Lundquist | 99/171 |
| 3,515,270 | 6/1970 | Tonn et al. | 206/56 |
| 3,556,292 | 1/1971 | Krzyzanowski | 206/56 |
| 3,556,337 | 1/1971 | Harmon | 220/31 |
| 3,559,799 | 2/1971 | Kramer et al. | 206/45.34 |
| 3,655,503 | 4/1972 | Stanley et al. | 161/165 |
| 4,370,369 | 1/1983 | Bonis | 428/35 |
| 4,599,849 | 7/1986 | Lundstrom | 53/427 |
| 4,615,926 | 10/1986 | Hsu et al. | 428/35 |
| 4,673,601 | 6/1987 | Lamping et al. | 428/35 |
| 4,691,820 | 8/1987 | Martinez | 206/205 |
| 4,866,911 | 9/1989 | Grindrod et al. | 53/432 |
| 4,986,673 | 1/1991 | Bell | 383/61 |
| 5,089,320 | 2/1992 | Straus et al. | 428/216 |

FOREIGN PATENT DOCUMENTS

| | | |
|---|---|---|
| 452040 | 10/1991 | European Pat. Off. . |
| 1544040 | 10/1968 | France . |
| 57-028777 | 2/1982 | Japan . |

*Primary Examiner*—Donald E. Czaja
*Assistant Examiner*—Anthony Weiev
*Attorney, Agent, or Firm*—Lockwood, Alex, FitzGibbon & Cummings

[57] ABSTRACT

A package, packaged food product and method are provided for packaging thin proteinaceous products such as sliced luncheon meats, cheeses and the like in a manner such that the thin products are supported by the packaging to resist shifting of the thin products within the package. The package has a generally bulbous-shaped cavity into which a doubled-over shingled stack of the products are sealed. The package includes a peelable and resealable feature which is preferably provided by films out of which the package is constructed.

30 Claims, 2 Drawing Sheets

PEELABLE AND RESEALABLE PACKAGE FOR THINLY SLICED MEATS AND THE LIKE

This application is a continuation of application Ser. No. 07/876,594, filed Apr. 30, 1992, now abandoned, which application was a continuation-in-part of application Ser. No. 07/696,327, filed Apr. 30, 1991, now U.S. Pat. No. 5,395,632, which application was a continuation of application Ser. No. 07/505,329, filed Apr. 5, 1990, now abandoned.

BACKGROUND AND DESCRIPTION OF THE INVENTION

The present invention generally relates to packages for hermetically sealing consumable products between generally opposing panels. More particularly, the invention relates to packages which are peelable and resealable and are uniquely well suited to packaging thinly sliced proteinaceous materials such as sliced luncheon meat in a manner which protects the integrity of the thinly sliced proteinaceous material while simultaneously providing the consumer with the ability to observe a substantial portion of one of the slices of proteinaceous product and in order to see at least a shingled edge portion of most or all of the other slices. Typically, the package includes a tamper-evidence feature which, in association with the peelable and resealable structure of the package, maintains a hermetic seal until the package is opened, at which time resealable access is gained to the contents of the package in a manner that clearly informs a potential purchaser or user the package had been opened.

Proteinaceous materials such as sliced luncheon meats, sliced cheeses and the like have long been packaged between generally opposing panels which are vacuum packaged or gas flushed and hermetically sealed in a manner which permits relatively easy opening by the application of digital forces or the like so as to provide access to the proteinaceous products by the consumer. In some instances, the packages include opposing flexible films. Other packages include rigid or semi-rigid components which define shaped cavities within which the stacked or shingled proteinaceous products are contained. Examples of these types of packages include those of U.S. Pat. Nos. 3,498,018 and No. 3,647,485, of Seiferth et al and No. 3,228,168, and No. 4,866,911, of Grindrod et al. In such packages, multiple proteinaceous products are arranged in stacks wherein the proteinaceous products are in one or more vertical stacks such that the proteinaceous products are directly one on top of another or are arranged in shingled fashion. In some instances, the packaging includes a vacuumizing procedure whereby a flexible film is pulled down over the stacked proteinaceous products in order to shape the film to closely overlie at least one face of the proteinaceous product stacks. Other packages are gas flushed, and the rigid, semi-rigid and/or flexible panels are not substantially changed in shape during vacuum/gas flushing to remove oxygen or other undesirable components from within the hermetically sealed package.

Vertically stacked or shingled products which have been packaged heretofore as discussed hereinabove have been used to package proteinaceous products other than those which are thinly sliced. Such customarily packaged proteinaceous products would typically have from about 8 to about 15 slices per inch of the vertical height of the stack. Thinly sliced proteinaceous products of the type suitable for packaging according to the present invention can be defined as including between about 16 and about 36 slices per inch of the vertical height of the stack.

Because of their thin and somewhat delicate nature, prior attempts to package thinly sliced proteinaceous products such as luncheon meat have not been particularly desirable. One example is that of products which are currently commercially available in which thin luncheon meat portions are packaged in a somewhat disorganized fashion between opposing flexible film panels. The haphazard manner in which these proteinaceous products are packaged and displayed tends to damage consumer confidence in the product, which can give the impression of a jumble of overly processed and/or restructured proteinaceous products. Consequently, at the present time, when a consumer wishes to purchase what is perceived to be a high quality luncheon meat and the like in thin portions, it is necessary for that consumer to purchase products which are freshly sliced at a deli counter or the like.

One of the advantages of packaging proteinaceous products into neat stacks in which the face of at least one of the proteinaceous products is clearly displayed is that such a packaging approach allows the muscle texture or structure defined in a proteinaceous meat product to be easily seen and appreciated by the consumer prior to purchasing the packaged goods. Even if a proteinaceous product does have a perceived advantageous muscle definition, this attribute of the proteinaceous product would not be readily observable by the consumer prior to purchase and opening of the package when the packaging does not consistently display a large portion of a generally flat surface of a slice of the product.

There is need for a packaging arrangement whereby thinly sliced proteinaceous products are packaged in a manner by which the product is arranged and maintained in neat stacks during distribution through commercial trade channels and upon being handled by consumers in retail storage compartments and/or display racks. It would be desirable to provide such a package wherein the slices do not shift uncontrollably during these types of normal commercial handling activities so as to provide a packaged product which enjoys consumer confidence both in the integrity of the package and the quality of the proteinaceous product therewithin. There is also a need to provide packaging of this type which can be readily sealed while being easily opened and resealed by simple pressure reclosure, especially packaging that has a tamper-evidence indicator.

In summary, the packages according to the present invention hermetically seal proteinaceous products between generally opposing panels, at least one of which is a non-planar panel. The non-planar panel includes an enclosure area which forms a generally wedge-shaped or bulbous-shaped package when sealed to the other panel. A peripheral flange area generally defines an access opening into this enclosure area. The other film is secured to the peripheral flange area in a manner by which a stack of thin proteinaceous items is hermetically sealed therewithin in a peelable and resealable manner. In a preferred embodiment, the package-enclosing compartment thus formed has an overall configuration having a substantially flat face and a generally opposing face which has a substantial portion thereof that is inclined with respect to the flat face. This provides a bulbous generally wedge-shaped enclosure that closely conforms to the shape of and thereby supports a shingled stack of thin proteinaceous products, which stack is folded onto itself in generally doubled-up fashion in order to thereby form a folded stack which also has an overall bulbous- or wedge-shaped configuration. Typically, these packages will be arranged for display, such as hanging from a peg or the like, according to an orientation in which the thickest depth of the bulbous-shaped configuration accommodates the folded portion of the shingled stack, and the thinner depth section of the enclosure accommodates the shingled edges of some of the shingled and folded pieces. In an especially preferred embodiment, a tamper-evidence feature is included whereby it is clear the package has been opened while allowing for resealability to permit easy closure of the package after opening of the tamper-evidence mechanism.

It is accordingly a general object of the present invention to provide an improved peelable and resealable package for thin proteinaceous products and to a method of forming such a package.

Another object of this invention is to provide an improved peelable and resealable package and method of assembling same which is especially suitable for displaying thinly sliced luncheon meats and the like which are arranged in a shingled stack that is folded over onto itself.

Another object of the present invention is to provide an improved peelable and resealable package and method which supports thin proteinaceous materials in a manner in which shifting is substantially prevented, even during distribution and marketing through commercial channels of trade.

Another object of the present invention is to provide a consumer-attractive peelable, resealable and tamper-evidence package which compactly displays at least a portion of substantially all of the slices of proteinaceous material stacked therewithin.

Another object of this invention is to provide an improved package and packaging method wherein the muscle definition of a meat product of the like is consistently visible from package to package, each package having peelable, resealable and tamper-evidence properties.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
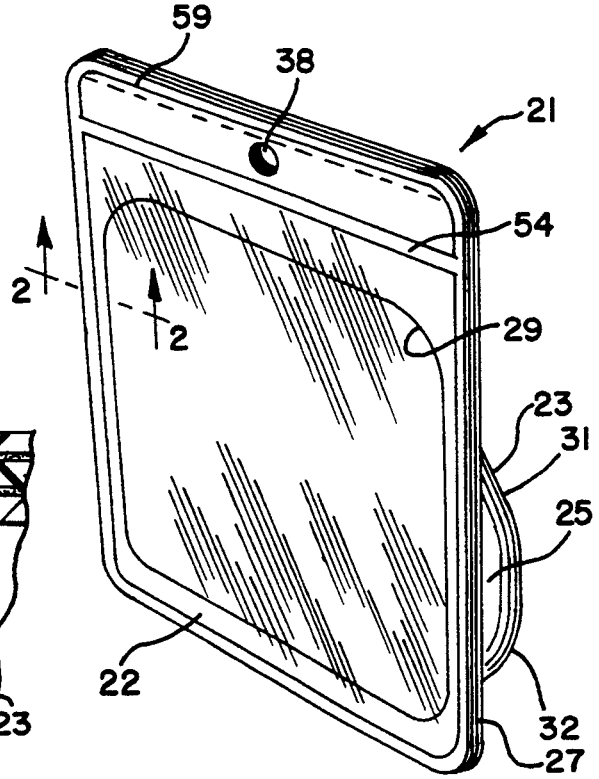
FIG. 1 is a perspective view of a package according to the present invention.

An illustrative, preferred package, generally designated as 21, is shown in FIG. 1. It includes a generally planar, and typically non-forming and flexible web panel or sheet 22 and a non-planar panel 23, which is typically made of a forming web. As can be perhaps best understood from FIG. 3, a product-enclosing compartment 24 is defined between the generally planar panel 22 and a generally wedge-shaped or bulbous formation or bubble 25 of the panel or web 23. Products 26, such as the luncheon meat slices shown in FIG. 3, are then suitably enclosed therewithin.

Figure 4:
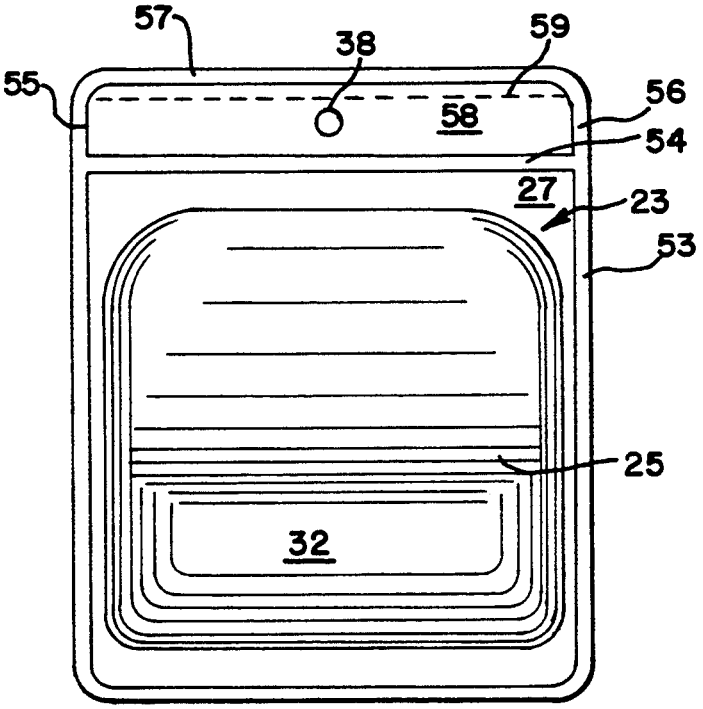
FIG. 4 is an elevational view of the package shown in FIG. 1 from a side thereof having a bulbous portion.
Figure 5:
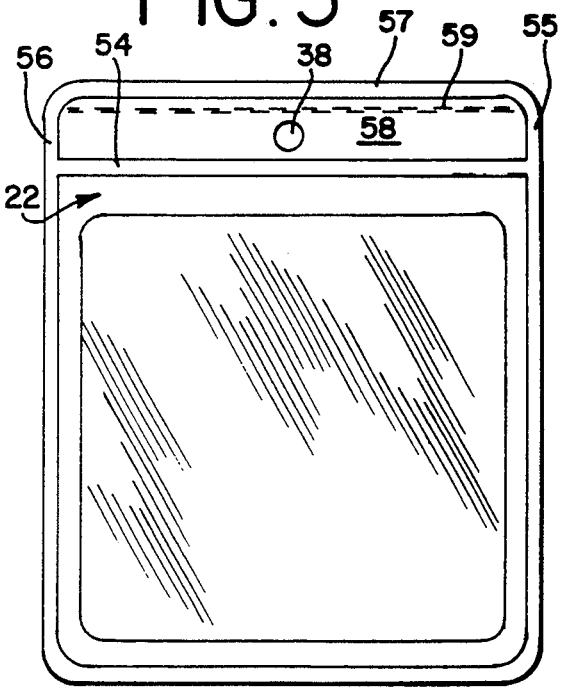
FIG. 5 is an elevational view of the package of FIG. 1 from a side thereof which is generally planar.

A flange 27 peripherally surrounds the generally wedge-shaped or bulbous formation of bubble 25 of the non-planar panel 23. This peripheral flange 27 is perhaps best seen in FIG. 4. The generally planar panel 22 is secured by suitable peelable and reclosable means to the surface of the peripheral flange 27 which opposes the panel 22 when the package 21 is assembled. Assembly means 28 provides a hermetic joining of the panels 22 and 23 which is peelable to the extent that the panels 22 and 23 can be readily separated by the application of digital forces directed in a manner so as to peel a portion or all of the generally planar panel 22 away from the peripheral flange 27 in order to gain access into the product-enclosing compartment 24 and any product 26 contained therewithin. Product removal is achieved through an access opening 29, which is generally defined by the inside edge of the peripheral flange 27. Assembly means 28 also has reseal properties whereby the package 21 is easily closed upon contact and slight closing pressure.

With more particular reference to the wedge-shaped or bulbous character of the formation or bubble 25, such includes an inclined surface 31, which tapers into a deeper pocket 32 which is somewhat U-shaped in cross-section. There is thus provided a bulbous compartment 25 which has a somewhat curved bottom portion providing a maximum compartment front-to-back thickness or depth. This somewhat bulbous bottom portion advantageously accommodates the product 26 in the area in which it is folded over onto itself. This bulbous configuration continues upwardly from the bottom of the generally wedge-shaped formation or bubble 25 for some distance until it tapers as the inclined surface 31 so that the compartment 24 has a minimum depth at its upper end.

Figure 3:
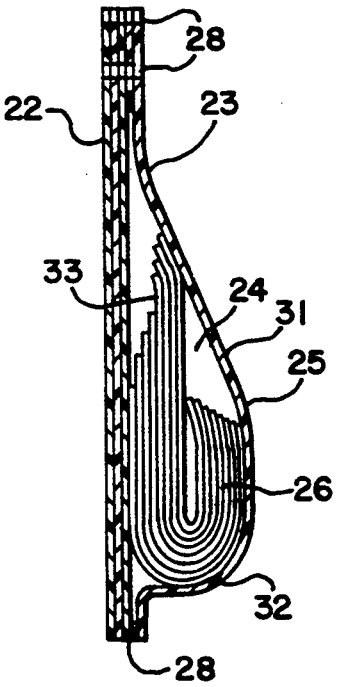
FIG. 3 is a side view, partially broken away, of the package according to FIG. 1 and showing shingled and folded slices of products therewithin.

With this structure, the product-enclosing compartment 24 is especially advantageous for enclosing a stack of thinly sliced proteinaceous products 26 which have been arranged in a shingled stack that is folded over onto itself in a manner such as that generally shown in FIG. 3. This product 26 thus has a generally U-shaped bulbous bottom portion having a substantial thickness and a shape which generally conforms to the shape defined by the deeper pocket 32. The inclined surface 31 then helps to support the upper portion of the folded product 26, which is in particular need of support due to its shingled arrangement and the fact that it is otherwise not particularly well supported by the remainder of the folded shingled stack. For example, a portion of the inclined surface 31 can generally engage at least the uppermost shingled edge of the product 26.

Panels 22, 23 can be transparent, opaque or translucent. Usually, it preferred to have at least one transparent panel to display the contents in the advantageous manner discussed herein. Both panels can be transparent. In the embodiment illustrated in FIGS. 3 and 4, the generally planar panel 22 is transparent, and the neat-looking shingled face of the folded product is visible through the panel 22. The non-planar panel 23 can be transparent or non-transparent; in the latter case, the folded-over face of the product 26 is not readily visible to the consumer. In addition, depending upon the amount of labeling or other decorative indicia that may be printed upon or otherwise affixed to the transparent panel 22, having this panel transparent will permit a clear viewing of about one-half of a substantially flat face of the slice of product which rests against the inside surface of the panel 22.

A somewhat similar packaging arrangement which instills a comparable degree of consumer confidence in the integrity and acceptability of the packaged product still can be achieved when the generally planar panel is opaque or otherwise not transparent and when the non-planar panel is generally transparent. In such a situation, it would typically be preferred to reverse the orientation of the product 26 from that shown in FIG. 3 to the extent that the shingled portion 33 faces and/or engages the inclined surface 31 of the package.

It will be appreciated that the product 26 intended to be stored within the product-enclosing compartment 24 takes the form of a plurality of very thin sheet-like items, any one of which would not readily remain in place without the support provided by the other slices and by the generally wedge-shaped or bulbous formation or bubble 25. The thinness of the items can be between about 16 and about 36, preferably between about 22 and about 36 slices per inch. Products of this type might be considered as having a disadvantage of not being particularly self-supporting. This apparent disadvantage is turned to an advantage in accordance with the present invention because this thinness facilitates the folding of the items onto themselves into the shingled, folded generally U-shaped configuration illustrated, for example, in FIGS. 3, 6, 7 and 8. With this arrangement, even though the individual items are unusually thin for many packaged food products, such as sliced luncheon meats, in many configurations approximately one-half of one of the items 34, 34' is visible through and may rest up against a panel of the package.

Figure 6:
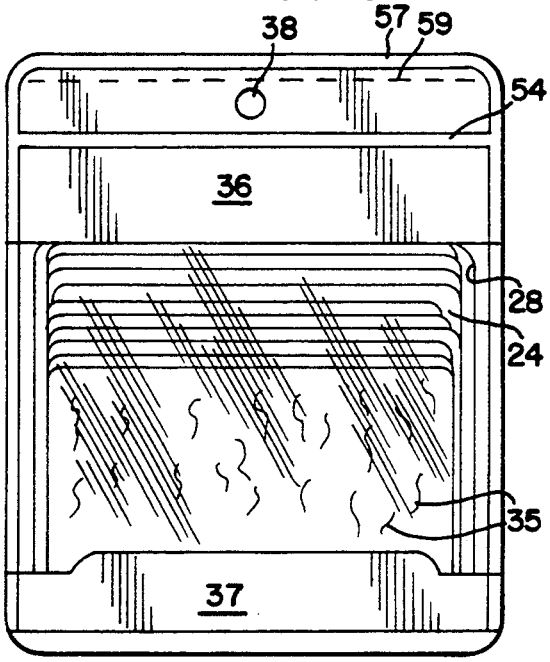
FIG. 6 is an elevational view of a package according to the present invention, when viewed from the side of a transparent panel and through which the shingled, folded stack of sliced product can be seen.
Figure 7:
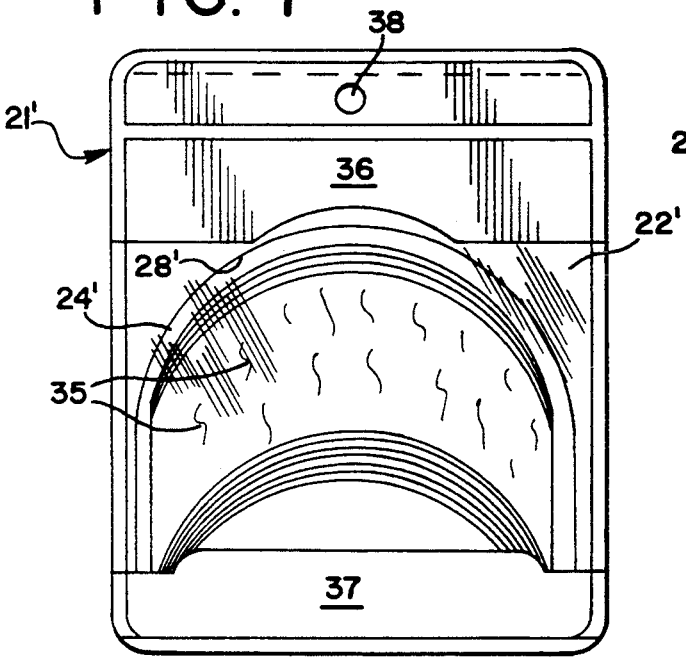
FIG. 7 is a view similar to that of FIG. 6 but showing an alternative embodiment.
Figure 8:
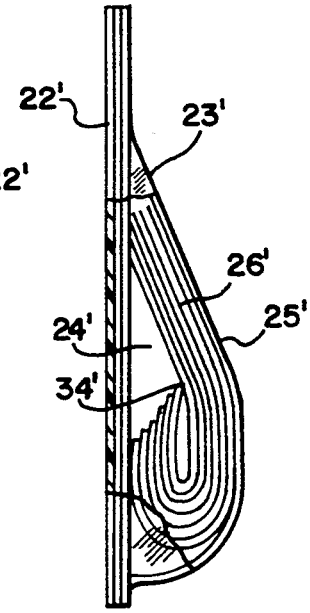
FIG. 8 is a side view, partially broken away, of the package according to FIG. 7.

As generally illustrated in FIGS. 6 and 7, the packages provide the consumer with an excellent opportunity to inspect the quality of the products prior to purchase, such as observing muscle definition 35. In the embodiments of FIGS. 6 and 7, adhesively secured or print-on label members 36 and 37 are illustrated. Any number of labels can be included, as desired. In FIG. 6, the access opening 28 to the product-enclosing compartment 24 is generally rectangular in shape, whereas in FIG. 7, the access opening 28' to the product-enclosing compartment 24' has a generally arched configuration; that is, the upper portion thereof is substantially circular. This former embodiment is particularly well-adapted for sliced products in which each slice has a generally rectangular configuration, and the latter embodiment is particularly well-suited for sliced products which are generally circular in configuration. Other shapes might also be possible when it is desired to have the product-enclosing compartment 24 conform as closely as possible to the shape of the folded-over shingled stack of product. FIGS. 7 and 8 also illustrate another orientation of the products 26' between generally planar panel 22' and a non-planar panel 23' having a bubble 25', the panels defining a package 21' having a compartment 24'.

As illustrated in the drawings, the packages preferably include a member for facilitating storage and display of a plurality of the packages. Illustrated in this regard is an orifice 38 of the type that is suitable for suspending the package from a generally horizontally oriented peg or the like in a manner that is well-known in the industry. When the package is suspended in a manner such as this, the combination of gravity and the overall general wedge or bulbous shape of the product-enclosing compartment help to prevent damage to the thinner items which are more likely to tear than thicker ones. Once the shingled and folded thin items are inserted into the product-enclosing compartment, the environment therewithin is treated such as by gas flushing or the like, the typically planar panel is sealed over the non-planar panel, and the package provides a substantially conforming environment which minimizes the chance that the individual items such as slices will move within the product-enclosing compartment and thus be damaged. In the FIG. 3 embodiment, the maximum thickness of the bulbous or generally U-shaped portion of the product-enclosing compartment is substantially the same as the thickness of the shingled and folded slices in the vicinity of the fold. This provides a close conformity condition which helps significantly in holding the product in place within the package. This condition is enhanced by the action of gravity upon the product within the suspended package, whereby the close relationship between the folded-over slices and the bulbous bottom portion of the product-enclosing compartment is maintained.

The panels for the packages according to the present invention can be made from a variety of multi-layered laminates or co-extrusions. The substantially planar panel preferably is suitable for providing a flexible sheet which can be readily peeled away from the other panel. The other panel is made of a material which preferably is formable into a shape including the flange and generally bulbous or wedge-shaped cavity as described elsewhere herein. Neither or both of the panels could be transparent, but it is preferably that at least one of them is transparent so that at least the flat slice portion 34 or the like can be easily viewed by the consumer prior to purchase of the package. In those instances where a non-transparent over-package is used, it should likewise permit, through openings or transparent portions thereof for example, easy inspection of the product through a transparent portion of the package. The panels should also be formulated so as to allow for the appropriate formation of a peelable and resealable seal for hermetically sealing the panels together. A typical peel seal for packages of this type can have a strength which ranges between about 1.0 and about 7.5 pounds/inch. In addition, the panels have a pressure-sensitive adhesive component and should provide gas barrier, particularly oxygen barrier, properties.

Also, when it is desired to include printing for displaying messages and/or for exhibiting coloration properties to one or both of the panels, the materials should be selected in order to achieve these objectives. It is often desirable that any such printing be affixed to an internal surface of a multi-layered panel so that the printing will be encapsulated within the panel. When so encapsulated, any such printing, coloration, or layer will be protected from contact with either the product within the package or with the environment outside of the package. By providing the printing or coloration at the interface between layers of a panel, the ink or the like will not interfere with the properties of the peel seal and will not cause any concerns for contacting same with a product such as food within the package.

Films or web materials are available which have resealabale peel seal characteristics. They are typically multi-layered, with the major layers being a tough supporting layer, a pressure sensitive adhesive component and a thin contact layer. Other layers or components may be included as discussed herein to provide additional properties or to secure layers together. In a typical package made from this type of resealable peel seal web, the thin contact layer is the inside layer which is sealed to a similar or an identical inside or contact layer of another web for making the package. These inside or contact layers are sealed together by pressure and/or heat. When peeled apart, a portion of the sealed area of one of the contact layers tears away from its pressure sensitive adhesive component and remains adhered to the contact layer of the other web. Thereafter, resealing is effected by reengaging this torn-away contact portion with the pressure sensitive adhesive from which it was separated when the package was opened. The pressure sensitive adhesive can be a component of the forming, non-forming, non-planar and/or substantially planar film or panel member. Examples of these types of resealable packaging materials are found in U.S. Pat. No. 5,089,320, of Straus et al, the subject matter of which is incorporated by reference hereinto.

Figure 2:
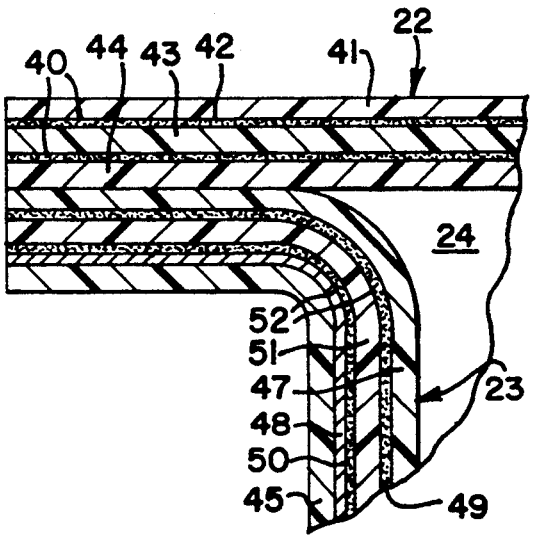
FIG. 2 is an enlarged, cross-sectional view along the line 2—2 of FIG. 1, showing a preferred peelable and sealable film arrangement.

An example of non-forming web material suitable for the panel 22 in accordance with this invention is a transparent multi-layered material having peel seal and oxygen barrier characteristics. With reference to FIG. 2, the tough supporting layer is an external or outside layer 41 which is a tough polymer, such as a 50 gauge printable polyester, for example polyethylene terephthalate, oriented polypropylene, or other olefin polymers or copolymers. When printing is not required a nylon such as Nylon 6 or other polyamide can be used. When printing is desired, ink or the like is most advantageously printed onto the inside surface 42 of the outside layer 41. Enhanced oxygen barrier properties can be achieved by a barrier layer 43, such as a 75 gauge combination of polyvinylidene chloride layers ("Saran") sandwiching oriented polypropylene, or a layer of ethylene vinyl alcohol copolymer (EVOH film), or a layer of polyvinylidene chloride film, or a combination of polyvinylidene chloride sandwiching polyethylene terephthalate.

The thin contact film of the panel 22 is the inside film 44 which engages the other panel 23. This thin contact or inside film 44 is associated with the pressure sensitive adhesive and readily breaks away to provide a peelable and resealable interface between it and the pressure sensitive adhesive. The polymer of such thin contact film has a tensile strength low enough so that the seal is easily opened while also exhibiting a low elongation at break. Examples of such materials include polyolefins such as polyethylenes, copolymers of ethylene and ethylenically unsaturated comonomers, film-forming copolymers of an olefin and an ethylenically unsaturated monocarboxylic acid having some of its acid groups neutralized by a metal ion, blends thereof, and the like. These latter copolymers are known as ionomer resins such as Surlyn (Registered Trademark) resin. A suitable inside film 44 is a Surlyn-containing multilayered film of high density polyethylene (total of about 35 percent), about 10 percent ethylene vinyl acetate, suitable quantities of pressure sensitive adhesive, and about 14 to 17 percent (approximately 0.3 mil) Surlyn resin film. This pressure sensitive adhesive may be of the hot-melt variety or otherwise responsive to heat and/or pressure used to provide the assembly means 28. The pressure sensitive adhesive may be included in this inside layer 44 of panel 22 or in a corresponding inside layer 47 of the non-planar panel 23. A typical thickness for the inside layer 44 is about 2 mils. Intermediate adhesive layers 40 typically adhere film layers 41, 43 and 44 together.

The non-planar panel 23 typically is, but need not be, a forming web made of a material which can be readily formed in a manner well-known in the industry, such as within a form/fill/seal machine. Panel 23 has heat sealing and oxygen barrier characteristics. A suitable outside layer 45 can be a nylon such as Nylon 6 or other polyamide material, a polypropylene material or a polyester material. It is desirable that such materials be tough and present an attractive appearance. Generally these materials, without treatment such as metallization, will be transparent and will be cast to about 1 mil in thickness. In those instances when the forming web is not to be transparent, a colored or metallized layer 50 can be included. An interior, relatively thick forming film 51 having a thickness of about 6 mils is preferably included. It can be a polyester, a nylon, a polyamide or the like. A preferred material is transparent such as a polyethylene terephthalate or Kodar (Trademark) resin, which is a thermoplastic polyester resin, 1,4-cyclohexylenedimethylene terephthalate/isophthalate copolymer. This layer 51 can vary or be omitted, depending upon the extent of shape-retention properties desired of the non-planar panel 23.

In addition, an inside layer 47 of the panel 23 similar to inside layer 44 of the panel 23 is provided. An example of an inside layer 47 is one about 2 mils thick which is a multilayered film of low density polyethylene, ethylene vinyl alcohol and Surlyn resin. Others are discussed herein with respect to the non-forming web. Intermediate adhesive layers 52 typically adhere film layers 45, 47 and 51 together. A typical alternative for the ethylene vinyl alcohol layer is Saran, or ethylene vinyl alcohol copolymer.

Opposing surfaces 44 and 47 which are present at the peripheral flange area 27 of the package are similar in order to facilitate maintenance of a peelable seal, as opposed to a permanent seal. The seal is also reclosable. More specifically, peripheral flange area 27 includes the assembly means 28 which consists of a generally peripheral seal component 53 and an intermediate seal component 54. Peripheral seal component includes side seals 55, 56 and a top edge seal 57. Seals 54, 55, 56 and 57 are hermetic and define an enclosed seal area 58. A tamper-evidence member 59 such as the illustrated perforation line is provided within the seal area 58. When the perforation line is torn and the area thereabove is severed and, if desired, completely removed from the package, it is readily apparent that the outside seal at the mouth of the package has been opened. In order to gain access to the intermediate hermetic seal, the tamper-evidence member 59 must be utilized by allowing access otherwise prevented by top seal 57. Once the package is opened, resealable characteristics of the films 22, 23 assist in maintaining freshness of product within the package after it has been opened.

A non-transparent condition optionally can be imparted such as to the non-planar or forming panel, by including coloration layers or the like. As an example, the outside layer 45 can have a metallized coating or layer 48 thereon, such as one imparting a silver color which is readily visible through the outside layer 45. Additional coloration can be imparted by including an ink layer, such as one having a generally orange color on the outside surface 49 of inside layer 47 in order to impart a gold-appearing colored layer that is visible through transparent layer(s) of the non-planar forming panel so that the coloration can be seen on the inside surface and on the flange area of the non-planar panel 23.

It will thus be seen that the present invention provides new and useful packaging having advantageous properties and characteristics, including those pointed out herein and others which are inherent in the invention. Preferred embodiments of the invention have been described by way of example, and it is anticipated that modifications may be made to those described herein without departing from the spirit of the invention or the scope of the appended claims.

We claim:

1. A packaged food product wherein thin proteinaceous products are hermetically sealed between generally opposing panels, comprising:

a non-planar panel member having a generally bulbous-shaped enclosure cavity and a peripheral flange area which peripherally defines an access opening of said generally bulbous-shaped enclosure cavity, the enclosure cavity being of varying depth, the depth in at least one portion of the cavity being deeper than the depth in at least one end thereof to define a deep end portion and a shallow end portion, respectively, and to further define an inclined surface therebetween;

a substantially planar panel member overlying said peripheral flange area and said access opening of the generally bulbous-shaped enclosure cavity in order to thereby close said cavity, said inclined surface of said non-planar panel member being opposite of and inclined with respect to said substantially planar panel member;

means for sealing said substantially planar panel member to said peripheral flange of the non-planar panel member, said sealing means including a peelable and resealable system having a thin contact layer generally enclosing a pressure sensitive adhesive, said thin contact layer being an inside surface of said non-planar panel, said substantially planar panel or both, said inside surface being in engagement with an inside surface of another of said panels;

a stack of thin slices of proteinaceous products hermetically sealed within a compartment defined by said generally bulbous-shaped enclosure cavity and said substantially planar panel member, said slices in said stack each having substantially-the same width and length, at least some of said slices being offset so as to be shingled relative to other slices in the stack and along a longitudinal axis whereby the stack is longer in a direction parallel to said axis than transverse to said axis, an entire face of the outermost slice on each side of the stack is exposed and an edge face of each of the shingled slices on each longitudinal end and on each side of the stack is also exposed, and the edge faces at one longitudinal end of said stack are folded over onto the shingled stack toward the edge faces at the other longitudinal end and in a direction parallel to said longitudinal axis to present a bulbous configuration and to shorten the length of and support the stack in said cavity, but to still simultaneously present the exposed edge faces at at least one longitudinal end and one side of the shingled stack together with a large portion of the exposed face of the outermost slice on said one side, said longitudinal axis extending between said deep end and shallow end portions of said cavity;

said compartment having said generally bulbous-shaped enclosure cavity is substantially complementary in shape, is larger in size, and engages both sides of said folded-over shingled stack of thin slices of proteinaceous products, one of said stack sides being in engagement with said substantially planar panel member, the other of said stack sides being in engagement with said inclined surface, and the folded over bulbous configuration of said stack being positioned in said deep end portion of the cavity, at least portion of at least one of said panel members being transparent to permit viewing simultaneously of said presented edge faces and large portion of the exposed face on said one side of the stack, whereby at least a portion of the proteinaceous product is displayed and whereby the slices are supported between the substantially planar-panel member and the inclined surface so as to not shift uncontrollably during commercial handling; and said package compartment is gas flushed and hermetically sealed.

2. The packaged food product according to claim 1, wherein said thin contact layer is selected from the group consisting of ionomer resins, polyethylenes, copolymers of ethylene and ethylenically unsaturated comonomers, and blends thereof.

3. The packaged food according to claim 1, wherein said thin contact layer is an ionomer resin.

4. The packaged food product according to claim 1, wherein said inclined surface engages at least a portion of the generally folded-over shingled stack of thin proteinaceous products.

5. The packaged food product according to claim 1, wherein said deep end portion includes a generally U-shaped surface linearly intersecting a bottom portion of the peripheral flange area at said deep end portion, whereby said generally U-shaped surface and at least a bottom portion of said substantially planar panel member define a bulbous portion of said enclosure cavity.

6. The packaged food product according to claim 1, wherein said generally folded-over shingled stack of thin proteinaceous products has a maximum thickness which is generally equal to a maximum depth of the generally bulbous-shaped enclosure cavity, said maximum depth being at said deep end portion of said cavity.

7. The packaged food product according to claim 1, wherein said substantially planar panel member is a non-forming multi-layered panel of a polyester outside layer, a peelable and resealable thin film inside contact layer, and a gas-barrier layer therebetween; and wherein said non-planar panel member is a multi-layered, gas-barrier, forming panel of a tough polymer web outside layer, a peelable and resealable thin film inside contact layer and a forming layer therebetween.

8. The packaged food product according to claim 7, wherein at least one of said peelable and resealable inside contact layers is a frangible film which includes a pressure sensitive adhesive whereby said frangible film and said pressure sensitive adhesive separate on peeling the package open and adhere together on reclosing the package.

9. The packaged food product according to claim 1, wherein at least one of said panels has a coloration layer which includes a metallized component.

10. The packaged food product according to claim 1, wherein at least one of said panel members is flexible.

11. The packaged food product according to claim 1, wherein at least one of said panel members is semi-rigid.

12. The packaged food product according to claim 1, including means for supporting the package for display whereby said panel members are substantially vertical.

13. The packaged food product according to claim 1, wherein said non-planar panel member is semi-rigid and said substantially planar panel member is flexible.

14. The packaged food product according to claim 13, including means for supporting the package for display whereby said panel members are substantially vertical.

15. The packaged food product according to claim 1, wherein said thin proteinaceous products are thinly sliced luncheon meat slices having a thickness of between about 16 and about 36 slices per inch.

16. A packaged food product wherein thinly sliced proteinaceous products are hermetically sealed between generally opposing panels, comprising:

a formed panel member having a generally wedge-shaped enclosure bubble cavity of varying depth in cross-section, the depth in at least one portion of said cavity being deeper than the depth in at least one end thereof, said cavity also having a planar access opening on one side thereof, and a substantially planar peripheral flange which surrounds and defines said access opening of said generally wedge-shaped enclosure bubble cavity and is substantially in the plane of said planar access opening;

a substantially flat planar panel member overlying said planar peripheral flange and said access opening of the generally wedge-shaped enclosure bubble cavity to thereby close said cavity;

means for sealing said substantially flat planar panel member to said planar flange of the formed panel member, said sealing means including a peelable and resealable system having a thin contact layer generally enclosing a pressure sensitive adhesive, said thin contact layer being an inside surface of said formed panel member, said substantially planar panel member or both, said inside surface being in engagement with an inside surface of another of said panel members; and a stack of thinly sliced proteinaceous products hermetically sealed within a compartment defined by said generally wedge-shaped enclosure bubble cavity and said substantially flat planar panel member, said stack being a shingled stack folded up onto itself into a generally doubled-over wedge-shaped configuration of shingled thinly sliced proteinaceous products; said compartment being substantially complementary in configuration to and somewhat larger in size than said doubled-over shingled stack of thinly sliced proteinaceous products, and engaging both a front face and a rear portion of said stack with the doubled-over portion of the stack positioned in said deeper portion of the cavity, at least a portion of at least one of said panel members being transparent to permit viewing of said proteinaceous products in said package.

17. The packaged food product according to claim 16, wherein said thin contact layer is selected from the group consisting of ionomer resins, polyethylenes, copolymers of ethylene and ethylenically unsaturated comonomers, and blends thereof.

18. The packaged food product according to claim 16, wherein said generally wedge-shaped bubble cavity of the non-planar panel member has a surface generally opposite to said substantially planar panel member, and said generally opposite surface has a substantial portion thereof which is inclined with respect to said substantially planar panel member.

19. The packaged food product according to claim 18, wherein said inclined portion engages at least a portion of the generally double-over shingled stack of thin proteinaceous products.

20. The packaged food product according to claim 18, wherein said generally opposite surface further includes a generally U-shaped surface at an end of said cavity opposite said one end, whereby said generally U-shaped surface and at least a bottom portion of said substantially planar panel member define a bulbous portion of said enclosure cavity.

21. The packaged food product according to claim 16, wherein said generally doubled-over shingled stack of thin proteinaceous products has a maximum doubled-over thickness which is generally equal to a maximum depth of the generally wedge-shaped enclosure cavity, said maximum depth being at an end of said cavity opposite said one end.

22. The packaged food product according to claim 16, wherein said substantially planar panel member is a non-forming multi-layered panel of a polyester outside layer, a peelable and resealable thin film inside contact layer, and a gas-barrier layer therebetween; and wherein said non-planar panel member is a multi-layered, gas-barrier, forming panel of a tough polymer web outside layer, a peelable and resealable thin film inside contact layer and a forming layer therebetween.

23. The packaged food product according to claim 22, wherein at least one of said peelable and resealable inside contact layers is a frangible film which includes a pressure sensitive adhesive whereby said frangible film and said pressure sensitive adhesive separate on peeling the package open and adhere together on reclosing the package.

24. The packaged food product according to claim 16, wherein at least one of said panels has a coloration layer which includes a metallized component.

25. The packaged food product according to claim 16, wherein at least one of said panel members is flexible.

26. The packaged food product according to claim 16, wherein at least one of said panel members is semi-rigid.

27. The packaged food product according to claim 16, including means for supporting the package for display whereby said panel members are substantially vertical.

28. The packaged food product according to claim 16, wherein said non-planar panel member is semi-rigid and said substantially planar panel member is flexible.

29. The packaged food product according to claim 16, wherein said thin proteinaceous products are thinly sliced luncheon meat slices having a thickness of between about 16 and about 36 slices per inch.

30. The packaged food product according to claim 16, wherein said compartment is gas flushed and hermetically sealed.

* * * * *

UNITED STATES PATENT AND TRADEMARK OFFICE

CERTIFICATE OF CORRECTION

PATENT NO. : 5,445,838

DATED : August 29, 1995

INVENTOR(S) : Jeffrey M. Lipinski and Brian P. Lawless

It is certified that error appears in the above-indentified patent and that said Letters Patent is hereby corrected as shown below:

Title page , the last name of the Assistant Examiner should be changed from "Weiev" to --Weier--.

Col. 3, line 43, delete "of" and insert --or--. (second occurrence).

Col. 9, line 64, delete the hyphen "-".

Col. 10, line 34, delete the hyphen "-"; line 45, after "food" insert --product--.

Signed and Sealed this

Eleventh Day of March, 1997

Bruce Lehman

*Attest:*

BRUCE LEHMAN

*Attesting Officer*

*Commissioner of Patents and Trademarks*